US007673398B2

(12) United States Patent
Koo

(10) Patent No.: US 7,673,398 B2
(45) Date of Patent: Mar. 9, 2010

(54) SHOE FOR SPORTS

(76) Inventor: Myung Hoe Koo, 18622 Nottingham La., Rowland Heights, CA (US) 91748

( * ) Notice: Subject to any disclaimer, the term of this patent is extended or adjusted under 35 U.S.C. 154(b) by 685 days.

(21) Appl. No.: 11/584,049

(22) Filed: Oct. 20, 2006

(65) Prior Publication Data

US 2008/0092409 A1 Apr. 24, 2008

(51) Int. Cl.
*A43B 5/00* (2006.01)
*A43C 13/04* (2006.01)

(52) U.S. Cl. ..... 36/67 D; 36/134

(58) Field of Classification Search ..... 36/134, 36/67 R, 67 D, 62, 65
See application file for complete search history.

(56) References Cited

U.S. PATENT DOCUMENTS 1,684,676 A * 9/1928 Lorenzi et al. ..... 36/32 R
2,258,805 A * 10/1941 Philips ..... 36/59 R
2,315,874 A * 4/1943 Sabel et al. ..... 36/127
2,607,135 A * 8/1952 Langer ..... 36/59 R
3,566,489 A * 3/1971 Morley ..... 36/67 D
3,685,175 A * 8/1972 Granger, Jr. ..... 36/67 R
3,731,406 A * 5/1973 Young ..... 36/67 D
4,318,232 A * 3/1982 Ching ..... 36/73
4,492,047 A * 1/1985 Arff ..... 36/134
5,029,405 A * 7/1991 DeHaitre ..... 36/134
5,036,606 A * 8/1991 Erich et al. ..... 36/134
5,938,384 A * 8/1999 Pratt ..... 411/55
5,957,642 A * 9/1999 Pratt ..... 411/55
2004/0187356 A1* 9/2004 Patton ..... 36/134

FOREIGN PATENT DOCUMENTS

GB 2028102 A * 3/1980

* cited by examiner

*Primary Examiner*—Marie Patterson
(74) *Attorney, Agent, or Firm*—John K. Park; Park Law Firm

(57) ABSTRACT

A shoe for sports that includes a shoe upper portion that is adapted to cover a user's foot, a ground friction device that is adapted to increase friction on a ground and an outer sole that is adapted to surround the user's foot together with the shoe upper portion. The outer sole includes one or more through holes, a top surface that supports the user's foot and a bottom surface. The ground friction device is assembled to the outer sole by being inserted into the through holes. The through hole includes a hole threaded portion, a lower end that is adjacent to the bottom surface of the outer sole and an upper end that is adjacent to the top surface of the outer sole.

5 Claims, 3 Drawing Sheets

SHOE FOR SPORTS

BACKGROUND OF THE INVENTION

The present invention is related to a shoe for sports. More particularly, this invention relates to a shoe that has a ground friction device that such as spikes, which may be assembled to the shoe from inside of the shoe.

A shoe with a ground friction device is needed for various sports such as golf, football or baseball. The shoe with the ground friction device is for helping runners or preventing slipping since the ground friction device increases friction on the ground. A lot of people and professional sports players play sports with the shoes with the ground friction device in a field or the ground, and the ground friction device is sometimes needed to replace because of various reasons such as breakage, defect or dirt.

A prior shoe with the ground friction device has a couple of problems with changing the ground friction device when the ground friction device is damaged or when a hole of the ground friction for an open device is often filled with dust, grass or water.

The reason for the above-mentioned problems is that the ground friction device is only opened from the bottom side of the shoe in order to separate it from the bottom surface of the outer sole.

This invention provides a solution for related problems by opening the ground friction device from the top side of the shoe in order to separate it from the bottom surface of the outer sole.

SUMMARY OF THE INVENTION

The present invention contrives to solve a problem that has not been addressed by the prior art.

An object of the invention is to provide a shoe for sports with a ground friction device that is assembled with ease and without contaminating a user's hand.

To achieve the above objects, the present invention provides a shoe for sports that includes a shoe upper portion that is adapted to cover a user's foot, a ground friction device that is adapted to increase friction on a ground and an outer sole that is adapted to surround the user's foot together with the shoe upper portion. The outer sole includes one or more through holes, a top surface that is adapted to support the user's foot and a bottom surface that is opposite to the top surface. The ground friction device is assembled to the outer sole by being inserted into the through holes.

The through hole includes a hole threaded portion, a lower end that is adjacent to the bottom surface of the outer sole and an upper end that is adjacent to the top surface of the outer sole. The ground friction device includes one or more friction elements, each of the friction elements Includes a cylindrical body and one or more protrusions that protrude from the body.

The recess is to engage a coin, or fits into a flat screwdriver or a Philips driver.

The cylindrical body includes a body threaded portion, which engages with the hole threaded portion.

In one embodiment, the through hole may further include a first annular recess and the friction element may further include a first sealing ring that is received in the first annular recess.

The through hole may further include a second annular recess, and the friction element may further include a second sealing ring that is received in the second annular recess.

The first annular recess is provided near the lower end of the through hole, and the second annular recess is provided near the upper end of the through hole.

The size of the protrusion is less than the diameter of the body.

The shoe for sports may further include an inner sole that is positioned on the top surface of the outer sole. The inner sole is adapted to protect user's foot from the outer sole and the end of the ground friction device.

The cylindrical body further includes a fastening recess provided on one end of the body, and the protrusions are provided on the other end of the body.

In another embodiment, the through hole may further include a first annular step, and the friction element further includes a first sealing ring that rests on the first annular step.

The through hole may further include a second annular step, and the friction element may further include a second sealing ring that rests on the second annular step.

The first annular step is provided near the lower end of the through hole, and the second annular step is provided near the upper end of the through hole The diameter of the first annular step is larger than the diameter of the body threaded portion, and the diameter of the second annular step is smaller than the diameter of the body threaded portion. The size of the protrusion is greater than the diameter of the body.

The outer sole may further include one or more inserts that are embedded in the outer sole, and the through hole is provided in the insert.

The advantages of the present invention are: the shoe for sports provides users with easy changing to the ground friction device; (1) when the protrusion of the ground friction device has been damaged; (2) when the hole of the outer sole for the ground friction device has been filled with dust, grass or water; and (3) when a recess of the ground friction for opening has been damaged or filled with dust.

Although the present invention is briefly summarized, the fuller understanding of the invention can be obtained by the following drawings, detailed description and appended claims.

BRIEF DESCRIPTION OF THE DRAWINGS

These and other features, aspects and advantage of the present invention will become better understood with reference to the accompanying drawings, wherein.

DETAILED DESCRIPTION OF THE INVENTION

Figure 1:
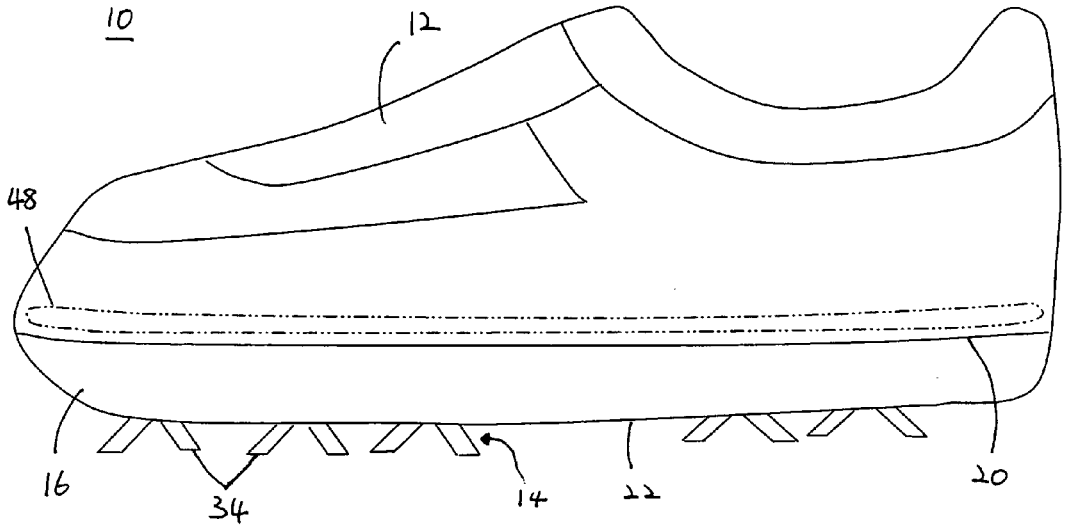
FIG. 1 is an elevation view of a shoe for sports according to the present invention.

FIG. 1 shows a shoe for sports 10 according to the present invention. The shoe 10 includes a shoe upper portion 12 that is adapted to cover a user's foot, a ground friction device 14 that is adapted to increase friction on a ground and an outer sole 16 that is adapted to surround the user's foot together with the shoe upper portion 12.

The shoe for sports 10 further includes an inner sole 48 that is positioned on the top surface 20 of the outer sole 14. The inner sole 48 protects user's foot from the outer sole 14 and the end of the ground friction device 14.

Figure 2:
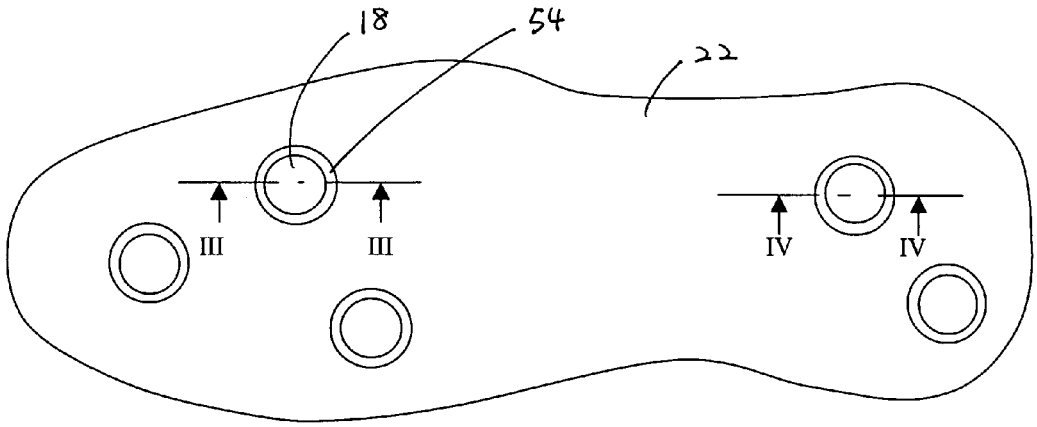
FIG. 2 is a bottom view of the shoe.

FIGS. 1 and 2 show that the outer sole 16 includes one or more through holes 18, a top surface 20 that is adapted to support the user's foot and a bottom surface 22 that is opposite to the top surface 20. The ground friction device 14 is assembled to the outer sole 16 by being inserted into the through holes 18.

Figure 3A:
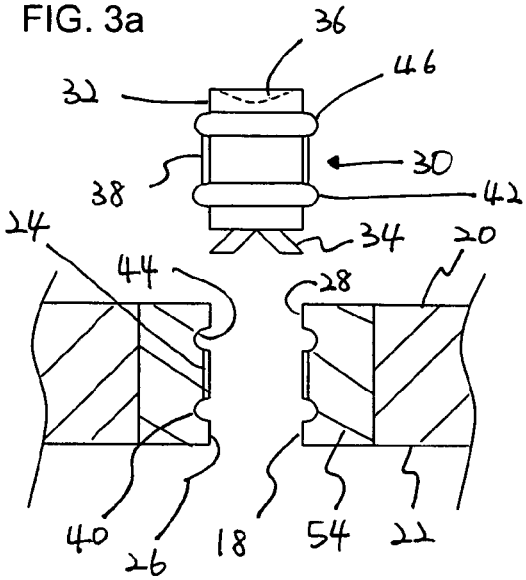
FIG. 3*a* is a cross-sectional view taken along line III-III of FIG. 2.
Figure 3B:
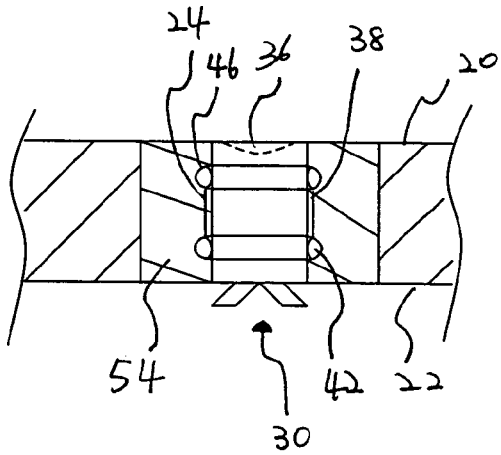
FIG. 3*b* is a cross-sectional view similar to FIG. 3*a* with a friction element assembled in an outer sole.

FIG. 3*a* and FIG. 3*b* show that the through hole 18 includes a hole threaded portion 24, a lower end 26 that is adjacent to the bottom surface 22 of the outer sole 16 and an upper end 28 that is adjacent to the top surface 20 of the outer sole 16. The ground friction device 14 includes one or more friction elements 30, each of the friction elements 30 Includes a cylindrical body 32 and one or more protrusions 34 that protrude from the body 32.

The cylindrical body 32 includes a body threaded portion 38, which engages with the hole threaded portion 24.

The through hole 18 further includes a first annular recess 40 and the friction element 30 further includes a first sealing ring 42 that is received in the first annular recess 40.

The through hole 18 further includes a second annular recess 44, and the friction element 30 further includes a second sealing ring 46 that is received in the second annular recess 44.

The first annular recess 40 is provided near the lower end 26 of the through hole 18, and the second annular recess 44 is provided near the upper end 28 of the through hole 18. The size of the protrusion 34 is less than the diameter of the body 32 so that the friction element 30 can be inserted into the through hole 18 from inside the shoe 10.

The outer sole 14 further includes one or more inserts 54 that are embedded in the outer sole 14, and the through holes 18 are provided in the inserts 54.

Figure 4A:
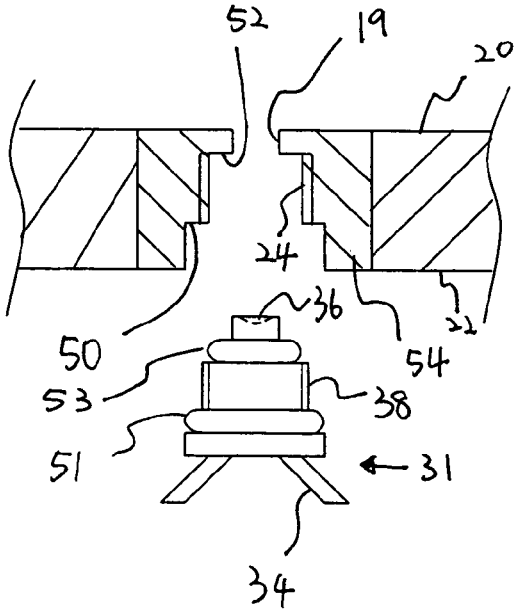
FIG. 4*a* is a cross-sectional view taken along line IV-IV of FIG. 2.
Figure 4B:
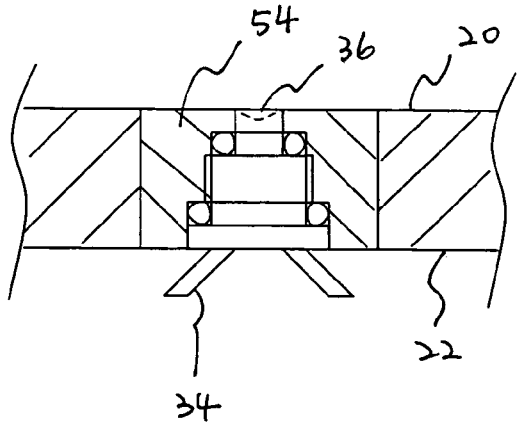
FIG. 4*b* is a cross-sectional view similar to FIG. 4*a* with another friction element assembled in the outer sole.

FIG. 4*a* and FIG. 4*b* show another embodiment. In this embodiment, a through hole 19 further includes a first annular step 50, and a friction element 31 further includes a first sealing ring 51 that rests on the first annular step 50.

The through hole 19 further includes a second annular step 52, and the friction element 31 further includes a second sealing ring 53 that rests on the second annular step 52.

The first annular step 50 is provided near the lower end of the through hole 18, and the second annular step 52 is provided near the upper end of the through hole 18.

The diameter of the first annular step 50 is larger than the diameter of the body threaded portion 38, and the diameter of the second annular step 52 is smaller than the diameter of the body threaded portion 38. The size of the protrusion 34 is greater than the diameter of the body 32. While the friction element 31 must be inserted form outside of the shoe, since a fastening recess is, which is explained below, may be accessed inside of the shoe, the friction element may be tightened or disassembled from inside of the shoe.

Figure 5:
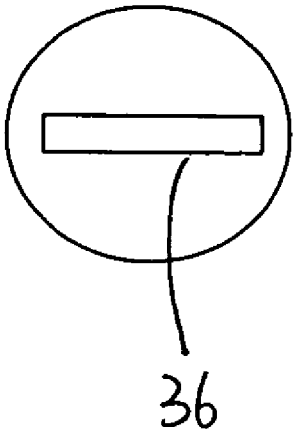
FIG. 5 is a plan view of a recess in a body of the ground friction device.
Figure 6:
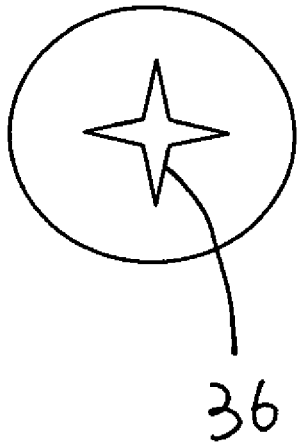
FIG. 6 is a plan view of another recess in the body of the ground friction device.

FIG. 5 and FIG. 6 show that the cylindrical body 32 further includes the fastening recess 36 provided on one end of the body, and the protrusions 34 are provided on the other end of the body. The fastening recess 36 is to engage a coin, or fits into a flat screwdriver or a Philips driver.

The ground friction device 14 may be provided as two pieces that include an upper piece and a lower piece. The two pieces are adapted to engage with each other through the opening of the outer sole 16.

The ground friction device 14 may have various shapes of protrusions 34 and the height of the protrusion 34 is eligible to change according to the condition of grass.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A shoe for sports comprising:

a) a shoe upper portion that is adapted to cover a user's foot;

b) a ground friction device that is adapted to increase friction on a ground; and c) an outer sole that is adapted to surround the user's foot together with the shoe upper portion, wherein the outer sole comprises one or more through holes, a top surface that is adapted to support the user's foot and a bottom surface that is opposite to the top surface, wherein the ground friction device is assembled to the outer sole by being inserted into the through holes;

wherein the through hole comprises a hole threaded portion, a lower end that is adjacent to the bottom surface of the outer sole and an upper end that is adjacent to the top surface of the outer sole, wherein the ground friction device comprises one or more friction elements, each of the friction elements comprises a cylindrical body and one or more protrusions that protrude from the body, and wherein the cylindrical body comprises a body threaded portion, which engages with the hole threaded portion;

wherein the through hole further comprises a first annular recess, wherein the friction element further comprises a first sealing ring, wherein the first sealing ring is received in the first annular recess; and wherein the through hole further comprises a second annular recess, wherein the friction element further comprises a second sealing ring, wherein the second sealing ring is received in the second annular recess, wherein the first annular recess is provided near the lower end of the through hole, wherein the second annular recess is provided near the upper end of the through hole.

2. The shoe for sports of claim 1, wherein the size of the protrusion is less than the diameter of the body.

3. The shoe for sports of claim 1, further comprising an inner sole that is positioned on the top surface of the outer sole.

4. The shoe for sports of claim 1, wherein the cylindrical body further comprises a fastening recess provided on one end of the body, wherein the protrusions are provided on the other end of the body.

5. The shoe for sports of claim 1, wherein the outer sole further comprises one or more inserts that are embedded in the outer sole, wherein the through hole is provided in the insert.

* * * * *